United States Patent [19]

Prescott, Jr. et al.

[11] Patent Number: 4,556,041

[45] Date of Patent: Dec. 3, 1985

[54] BOW STRING GRIP AND RELEASE

[76] Inventors: Leo L. Prescott, Jr., 10401 Calle Trece; Bryon C. Eddy, 10441 Calle Trece, both of Tucson, Ariz. 85748

[21] Appl. No.: 510,375

[22] Filed: Jul. 1, 1983

[51] Int. Cl.[4] ..... F41B 5/00

[52] U.S. Cl. ..... 124/35 A

[58] Field of Search ..... 124/35 A, 24 R, 23 R, 124/37

[56] References Cited

U.S. PATENT DOCUMENTS

| | | | |
|---|---|---|---|
| 4,004,564 | 1/1977 | Castonguay | 124/35 A |
| 4,282,851 | 8/1981 | Lyons | 124/35 A |
| 4,316,443 | 1/1982 | Giacomo | 124/35 A |

*Primary Examiner*—Richard J. Apley
*Assistant Examiner*—William R. Browne
*Attorney, Agent, or Firm*—Harvey B. Jacobson

[57] ABSTRACT

An elongated body is provided for gripping in the hooked fingers of the user's bow string pulling hand and including a front side for opposing the phalanges of the forefingers of the user's hand between the first and second joints thereof and a first end for opposing the thumb of the user. A pair of forwardly outwardly divergent guides are carried by the front side and are slightly spaced apart longitudinally of the body. The divergent guides are spaced from and closer to the first end than the opposite end of the body and releasable bow string engaging anchor structure is carried by the body closely inwardly of the spacing between the guides and shiftably supported from the body for movement between bow string anchoring and bow string release positions. Release structure is carried by the body and operative from adjacent the first body end by the user's thumb for releasing the bow string engaging anchor structure.

2 Claims, 8 Drawing Figures

BOW STRING GRIP AND RELEASE

BACKGROUND OF THE INVENTION

Various forms of bow string releases heretofore have been provided to assist an archer in drawing and holding drawn the string of a bow. Examples of these previously known forms of bow string releases are disclosed in U.S. Pat. Nos. 3,898,974, 3,954,095, 3,998,202, 4,004,564, 4,009,703 and 4,232,649. However, most of these bow string releases include forwardly facing finger-engaging edges considerably forwardly of which bow string anchor structure is provided and these types of bow string releases are difficult to engage with a bow string by feel or instinct when visually concentrating upon a target in a hunting situation. In addition, many of these previously known forms of bow string releases include trigger mechanisms which are operable by the user's forefinger and which therefore prevent the user's forefinger from being used to share a full portion of the pull on the bow string release. Accordingly, a need exists for an improved form of hand held bow string release which will enable all four fingers of the user's hand to apply the drawing force on the associated bow string and the user's thumb to function as the release operator for the bow string. Also, there is a need for a bow string release with whose releasable bow string anchor the string of a bow may be readily engaged by feel or instinct.

BRIEF DESCRIPTION OF THE INVENTION

The bow string release of the instant invention comprises an elongated structure adapted to be hand held by the user in the hooked portions of the user's fingers and with the bow string release horizontally disposed when the associated bow string is vertically disposed. In this manner, a more natural position of the user's arm may be taken when an associated bow string is drawn. Further, the bow string release is constructed in a manner whereby the bow string to be engaged thereby is received between the first joints of the first and second fingers of the user of the bow string release thereby enabling ready engagement of the bow string release with a bow string by feel or by instinct.

The main object of this invention is to provide a bow string release for use by archers wherein the associated bow string will be received between the first and second hooked fingers of the hand of the user used to draw the bow string.

Another object of this invention is to provide a bow string release constructed in a manner whereby the user's hand will be disposed in a horizontal plane when the associated bow string is vertically disposed.

Yet another important object of this invention is to provide a bow string release which may be engaged with an associated bow string by feel or instinct while the user is visually attentive to a hunting target.

Another object of this invention is to provide a bow string release which will enable the hand of the user performing the bow drawing operation to be pulled to a position closely adjacent the cheek of the user.

A final object of this invention to be specifically enumerated herein is to provide a bow string release in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
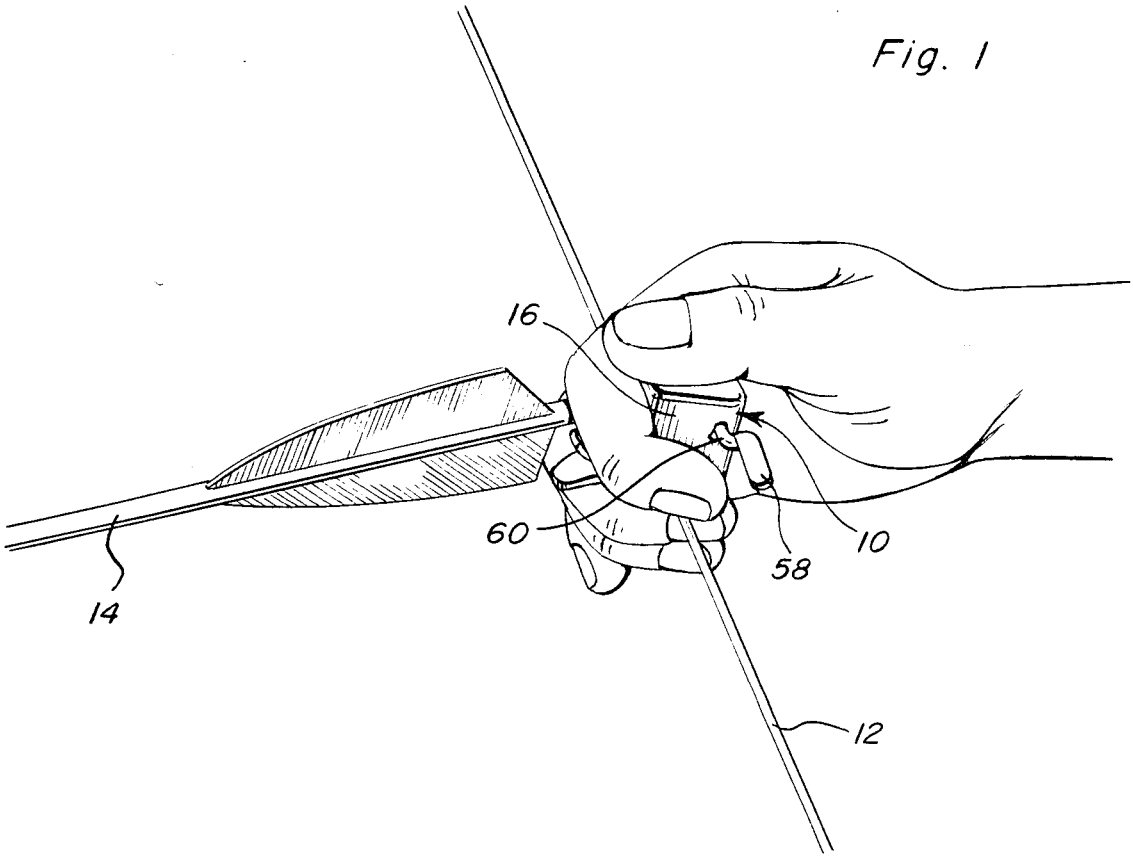
FIG. 1 is a perspective view of the bow string release as hand held and operatively engaged with a bow string having an arrow nocked therewith.
Figure 2:
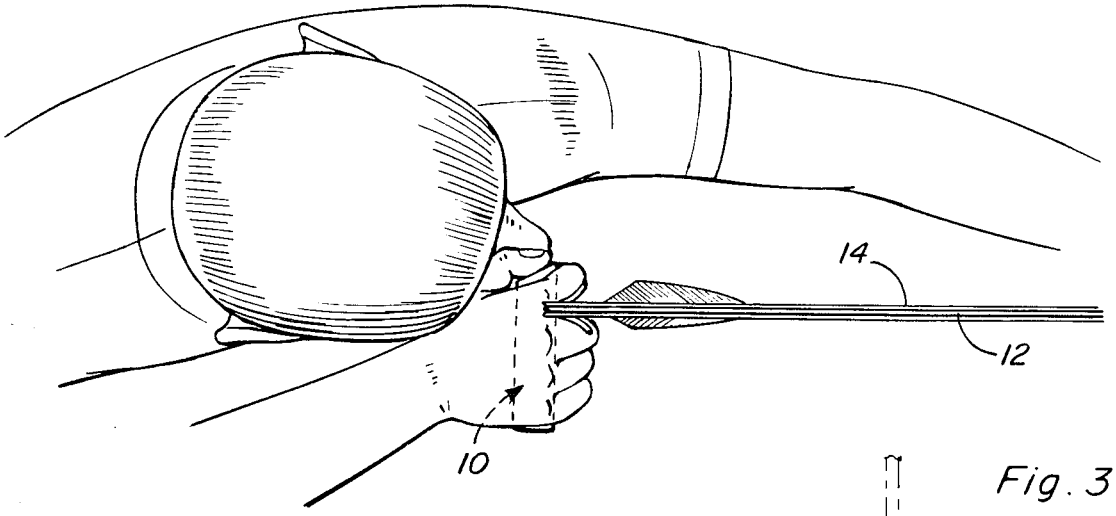
FIG. 2 is a top plan view of the bow string release as being held by an archer in the bow string drawn position.
Figure 3:
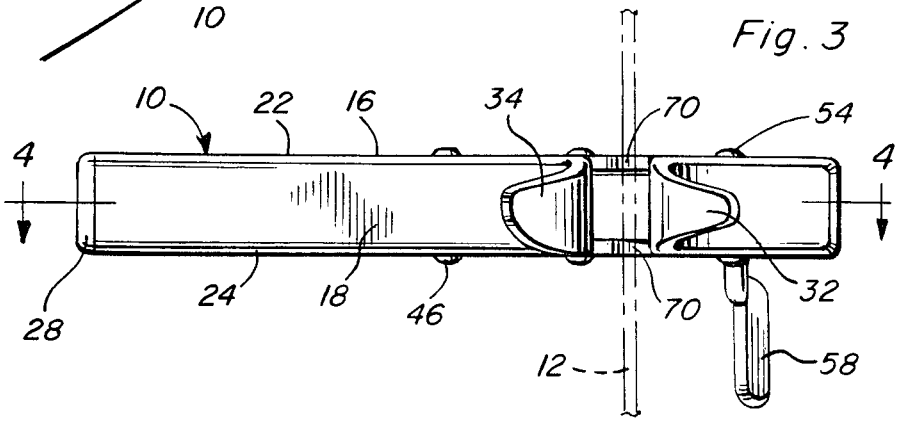
FIG. 3 is an enlarged front elevational view of the bow string release.

Referring now more specifically to the drawings the numeral 10 generally designates the bow string release of the instant invention. The release 10 is illustrated in FIGS. 1 and 2 of the drawings as releasably anchorably engaged with the mid-portion of a bow string 12 having the rear end of an arrow 14 nocked therewith.

The bow string release includes a hollow elongated housing 16 of generally rectangular cross section and including front and rear walls 18 and 20, top and bottom walls 22 and 24, a fixed first inclined end wall 26 and a second removable plug-type end wall 28.

The front wall 18 has an opening 30 formed therein spaced from the end wall 26 but closer to the end wall 26 than the end wall 28 and a pair of forwardly and outwardly divergent arcuate guides 32 and 34 project outwardly from the front wall 18 on opposite sides of the opening 30.

Figure 4:
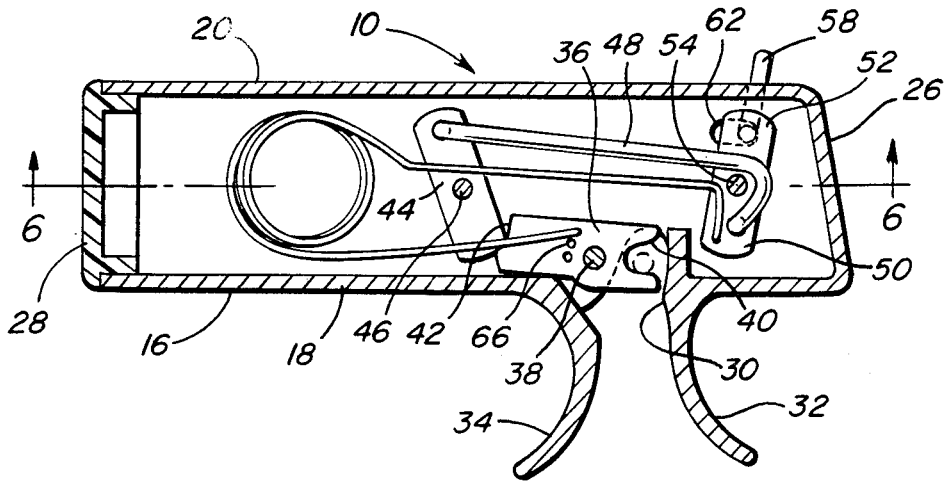
FIG. 4 is a horizontal sectional view taken substantially upon the plane indicated by the section line 4—4 of FIG. 3 and with the bow string engaging an anchor means in the bow string anchoring position.

A bow string engaging and release anchor lever 36 is pivotally mounted by a pivot pin 38 whose upper and lower ends are anchored relative to the top and bottom walls 22 and 24 and a first end of the lever 36 includes an endwise outwardly opening notch 40 while the second end of the lever 36 is stepped as at 42. A latch lever 44 is pivotally mounted by a pivot pin 46 whose opposite ends are anchored relative to the top and bottom walls 22 and 24 and a first end of the lever 44 is engaged with the stepped portion 42 of the lever 36 for retaining the lever 36 in the bow string anchoring position thereof illustrated in FIG. 4. The end of the lever 44 remote from the end thereof engaged with the stepped end of the lever 36 has one end of an operating link 48 pivotally anchored relative thereto and the other end of the operating link 48 is pivotally anchored to a first end 50 of a release lever 52 pivotally mounted between the top and bottom walls 22 and 24 by a pivot pin 54. The second end 56 of the release lever 50 includes a laterally outwardly projecting thumb-engageable tab 58 whose mounting shank portion 60 is slidably received through a slot 62 formed in the bottom wall 24 adjacent the inclined end wall 26.

Figure 5:
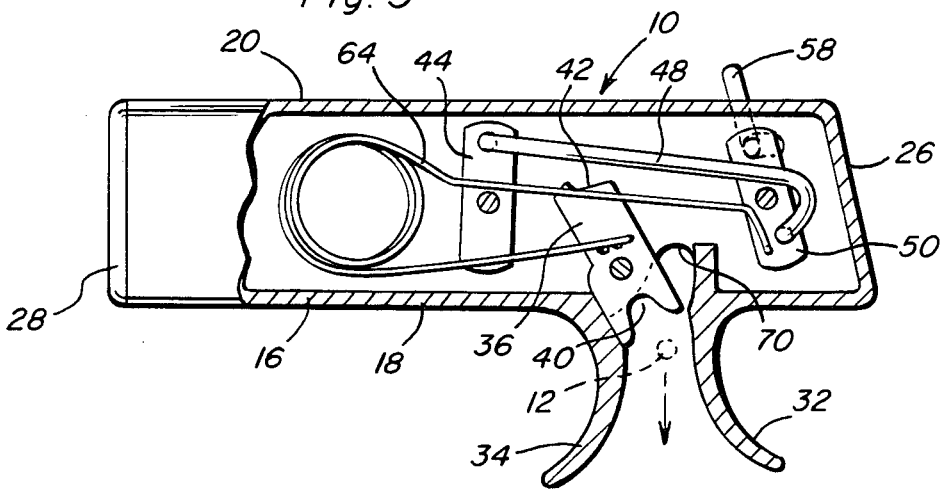
FIG. 5 is a top plan view of the bow string release with parts thereof being illustrated in horizontal section and the bow string anchor means in the release position.
Figure 6:
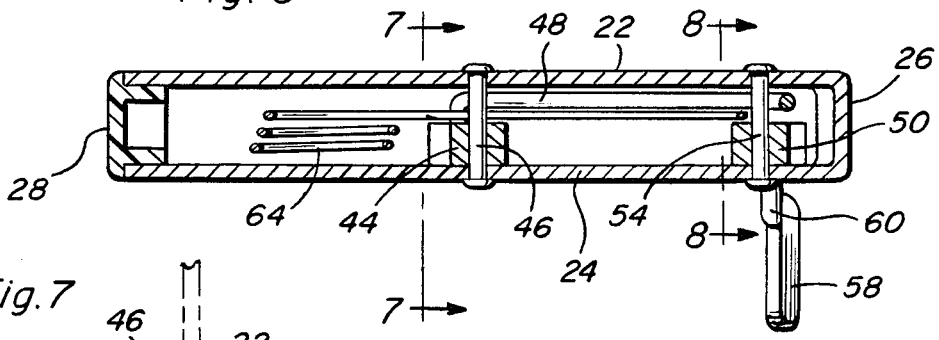
FIG. 6 is a vertical sectional view taken substantially upon the plane indicated by the section line 6—6 of FIG. 4.
Figure 7:
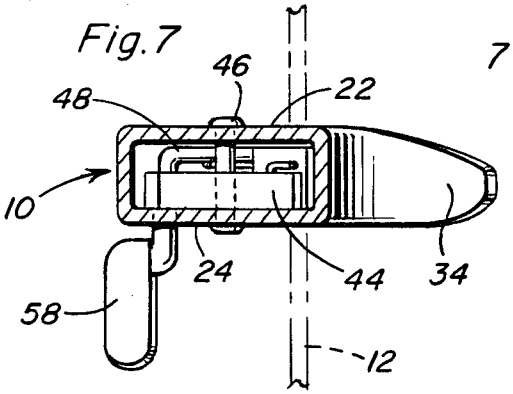
FIG. 7 is a transverse vertical sectional view taken substantially upon the plane indicated by the section line 7—7 of FIG. 6.
Figure 8:
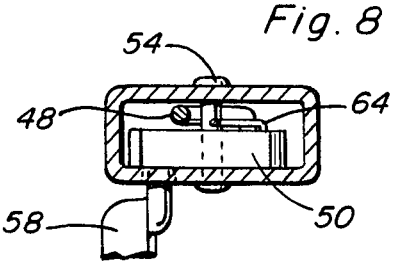
FIG. 8 is a transverse vertical sectional view taken substantially upon the plane indicated by the section line 8—8 of FIG. 6.

A coiled butterfly spring 64 has one end thereof engaged with the end of the release lever 50 with which the link 48 is engaged and the other end of the spring 64 is engaged with the lever 36 between the stepped portion 42 thereof and the pin 38. The spring 64 serves to yieldingly bias the lever 36 from the position thereof illustrated in FIG. 4 to the position thereof illustrated in FIG. 5 and also to yieldingly bias the lever 50 from the position thereof illustrated in FIG. 5 to the position thereof illustrated in FIG. 4. The end of the spring 64 engaged with the lever 36 includes a laterally directed end portion selectively engageable in one of a plurality of small diameter bores 66 formed in the lever 36. Selected bores 66 for anchoring the adjacent end of the spring 64 relative thereto function to vary the biasing action of the spring 64 on the lever 36.

With attention now invited more specifically to FIGS. 1 and 2 of the drawings it will be seen that the housing or body 16 of the bow string release 10 is held behind the hooked four fingers of the user's hand with the front wall 18 of the housing 16 opposing the phalanges of the four fingers of the user's hand between the first and second joints thereof. In addition, the guides 32 and 34 are straddled between the first joints of the first and second fingers of the user and the notch 40 of the lever 36 is positioned substantially flush with the plane of the front wall 18 when the lever 36 is in the arrow string engaging and release position illustrated in FIG. 5.

When the user's hand is aligned with his forearm the notch defined between his first and second fingers is aligned with the forearm of the user and is the most convenient and readily usable recess-defining portion of the hand in which to receive a bow string by feel or instinct when the user is visually concentrating on a hunting target. Accordingly, with the guides 32 and 34 extending outward between and diverging away from the forward sides of the user's first and second fingers a bow string may be readily received between the guides 32 and 34 and engaged in the inner end of the notch 40 when the lever 36 is in the position thereof illustrated in FIG. 5. The opening 30 is registered with vertical openings or notches 70 formed in the top and bottom walls 24 for receiving the bow string therethrough and once the bow string has been engaged in the notch 40 continued rearward movement of the bow string will cause the lever 36 to pivot against the biasing action of the spring 64 from the position of the lever 36 illustrated in FIG. 5 to the position thereof illustrated in FIG. 4 allowing the spring biased lever 44 to seat in the stepped portion 42 of the lever 36 in order to latch the lever 36 in the position thereof illustrated in FIG. 4 wherein the bow string 12 is anchored relative to the lever 36. Then, the user may pull back rearwardly on his hand supporting the bow string release 10 to the ready position shown in FIG. 2 and he may slip his thumb from engagement with the inclined end 26 of the housing 16 down to engagement with the tab 58. Thereafter, a slight pressure on the tab 58 will cause the lever 50 to pivot from the position thereof illustrated in FIG. 4 to the position thereof illustrated in FIG. 5 and the link 48 to thus pivot the lever 44 from the latching position thereof illustrated in FIG. 4 to the release position illustrated in FIG. 5 so that the tension of the bow string 12 will pivot the lever 36 from the bow string anchoring position of FIG. 4 to the bow string release position of FIG. 5.

It will be noted that when the bow string release 10 is used in the manner illustrated in FIG. 2 to fully draw an associated bow string, the user's hand is in a comfortable palm downward position. Further the base end of the user's thumb may be drawn up tightly against the cheek of the user whereby the corresponding eye of the user may sight along the plane containing the center lines of the bow and the bow string. Thus, the construction of the bow string release 10 not only assists in initial engagement of the release with the bow string, but also enables a natural arm and hand position when the associated bow string is fully drawn. Further, the bow string release enables the user to sight in the plane containing the center lines of the associated bow and bow string and to utilize all four of his fingers to share in applying sufficient force to draw the associated bow string while using his thumb to release the bow string when desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bow string release including an elongated body for gripping in the hooked fingers of the user's bow string pulling hand and including a front side for opposing the phalanges of the user's hand between the first and second joints thereof and a first end for opposing the thumb of the user, a pair of guides carried by said front side and slightly spaced apart longitudinally of said body, said guides including forwardly divergent opposing surfaces and being spaced from and closer to said first end than the opposite end of said body, releasable bow string engaging anchor means carried by said body closely inwardly of the spacing between said guides and shiftably supported from said body for movement between bow string anchoring and bow string release positions, and release means operative from adjacent said first end by the user's thumb for releasing the bow string anchor means, said releasable bow string engaging anchor means including a lever pivotally mounted in said body intermediate its opposite ends and including an endwise outwardly opening transverse notch in one end, said lever being angularly displaceable between a bow string release position with said notch opening endwise outwardly between said base ends of said guides and a bow string anchoring position with said notch opening in a direction transverse to said guides and extending longitudinally of said body, latch means mounted in said body for movement between latching and unlatched positions and operable to latch said lever in the bow string anchoring position when in the latching position and to release said lever for movement thereof to the release position when in the unlatched position, single spring means operably connected with said latch means and said lever yieldingly biasing said latch means toward said latching position and said lever toward said bow string release position, and latch means release structure disposed exteriorly of said body adjacent said first end for engagement by the thumb of a user to shift said latch means toward the unlatching position thereof and to thereby release said lever for movement toward the bow string release position.

2. The bow string release of claim 1 wherein said single spring means includes a coiled butterfly spring whose opposite ends are anchored relative to said lever and latch means.

* * * * *